US007823879B2

(12) United States Patent
Vargas

(10) Patent No.: US 7,823,879 B2
(45) Date of Patent: Nov. 2, 2010

(54) APPARATUS FOR DESKEWING SHEET MEDIA

(75) Inventor: Gil Alfredo Vargas, Kabankalan (PH)

(73) Assignee: Lexmark International, Inc., Lexington, KY (US)

( * ) Notice: Subject to any disclaimer, the term of this patent is extended or adjusted under 35 U.S.C. 154(b) by 302 days.

(21) Appl. No.: 11/672,532

(22) Filed: Feb. 8, 2007

(65) Prior Publication Data

US 2008/0191411 A1 Aug. 14, 2008

(51) Int. Cl.
*B65H 9/04* (2006.01)

(52) U.S. Cl. ..... 271/245; 271/234

(58) Field of Classification Search ..... 271/245, 271/243, 229, 234, 236, 239
See application file for complete search history.

(56) References Cited

U.S. PATENT DOCUMENTS 6,011,948 A * 1/2000 Amano et al. ..... 399/395
6,394,447 B1 * 5/2002 Kawai et al. ..... 271/186
6,974,128 B2 12/2005 Quesnel
7,128,318 B2 10/2006 Loiselle

* cited by examiner

*Primary Examiner*—Patrick Mackey
*Assistant Examiner*—Ernesto Suarez

(57) ABSTRACT

An apparatus for deskewing a media sheet includes a sheet feed system for transporting the media sheet along a media feed path in a media feed direction. A split alignment gate is positioned to intersect the media feed path. The split alignment gate subjects the media sheet to a deskewing force, wherein an amount of the deskewing force is determined based on a width of the media sheet in a direction transverse to the media feed direction.

19 Claims, 8 Drawing Sheets

APPARATUS FOR DESKEWING SHEET MEDIA

BACKGROUND OF THE INVENTION

1. Field of the Invention

The present invention relates to transporting sheet media, and, more particularly, to an apparatus for deskewing sheet media.

2. Description of the Related Art

Various types of sheet registration systems have been used to deskew a media sheet in a sheet path of an imaging apparatus, such as a printer. One common sheet registration system is one in which the leading edge of the sheet is partially buckled against a registration device in the sheet path. The registration device may be provided, for example, by temporarily stalled or slower speed sheet feed roller nips, retractable fingers or pins. In another type of sheet registration system that may be used for deskewing flimsy print media sheets, the moving sheet is partially buckled by at least one edge of the sheet engaging the registration system, wherein a transversely pivotal baffle member overlies at least part of the buckled sheet to at least partially define a sheet buckle chamber for the buckled sheet.

What is needed in the art is an apparatus for deskewing sheet media that provides a variation in the deskewing properties of the alignment gate depending on the width of the media sheet.

SUMMARY OF THE INVENTION

The present invention provides an apparatus for deskewing a media sheet that provides a variation in the deskewing properties of the alignment gate depending on the width of the media sheet.

The terms "first" and "second" preceding an element name, e.g., first gate member, second gate member, etc., are used for identification purposes to distinguish between similar elements, and are not intended to necessarily imply order, nor are the terms "first" and "second" intended to preclude the inclusion of additional similar elements.

The invention, in one form thereof, is directed to an apparatus for deskewing a media sheet. The apparatus includes a sheet feed system for transporting a media sheet along a media feed path in a media feed direction. A split alignment gate is positioned to intersect the media feed path. The split alignment gate subjects the media sheet to a deskewing force, wherein an amount of the deskewing force is determined based on a width of the media sheet in a direction transverse to the media feed direction.

The invention, in another form thereof, is directed to an imaging apparatus. The imaging apparatus includes a print engine and a sheet feed system configured to transport sheet media in a media feed direction along a media feed path to the print engine. The sheet feed system includes a main frame and a plurality of rollers. A split alignment gate is coupled to the main frame. The split alignment gate has a first gate member and a second gate member. A first biasing spring is coupled between the first gate member and main frame. A second biasing spring is coupled between the second gate member and the main frame. The first gate member and the second gate member are configured such that the first gate member is biased to a gating position by both the first biasing spring and the second biasing spring, and the second gate member is biased to the gating position by only the second biasing spring.

The invention, in another form thereof, is directed to an imaging apparatus. The imaging apparatus includes a print engine and a sheet feed system configured to transport sheet media in a media feed direction along a media feed path to the print engine. The sheet feed system includes a main frame and a driven input roller. The driven input roller has a shaft oriented transverse to the media feed direction that is rotatably mounted to the main frame. A split alignment gate is attached to the shaft of the input rollers. The split alignment gate has a first gate member and a second gate member. The first gate member has a first gating projection spaced apart from a second gating projection. The second gate member has a third gating projection spaced apart from a fourth gating projection. The third gating projection and the fourth gating projection of the second gate member are positioned between the first gating projection and the second gating projection of the first gate member. A first biasing spring is coupled between the first gate member and the main frame. A second biasing spring is coupled between the second gate member and the main frame. The first gate member and the second gate member are configured such that first gate member is biased to a gating position by both the first biasing spring and the second biasing spring. The second gate member is biased to the gating position by only the second biasing spring.

BRIEF DESCRIPTION OF THE DRAWINGS

The above-mentioned and other features and advantages of this invention, and the manner of attaining them, will become more apparent and the invention will be better understood by reference to the following description of an embodiments of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
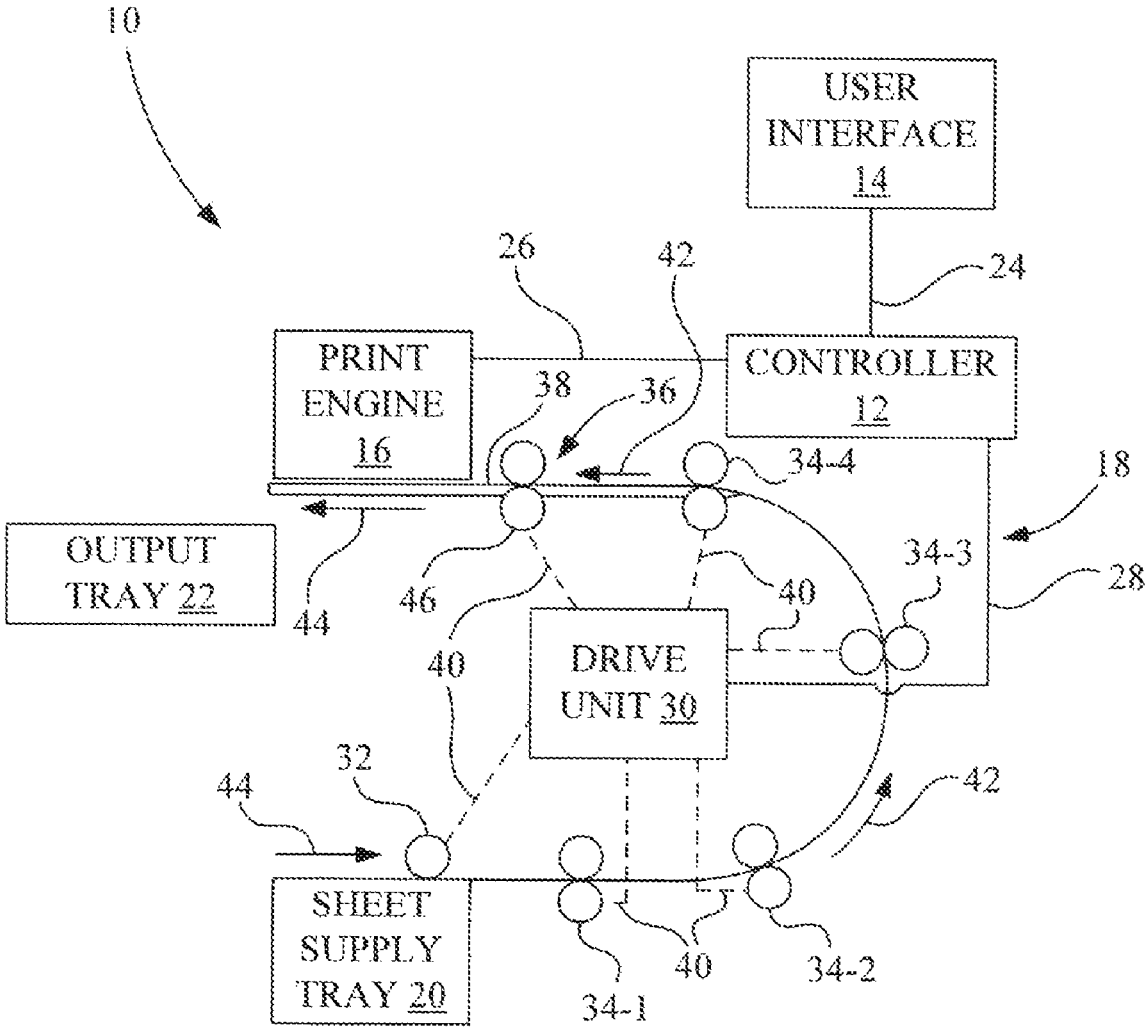
FIG. 1 is a diagrammatic illustration of an imaging system embodying the present invention.

Referring now to the drawings and particularly to FIG. 1, there is shown an imaging apparatus 10 embodying the present invention. In the present invention, imaging apparatus 10 includes a controller 12, a user interface 14, a print engine 16, a sheet feed system 18, a sheet supply tray 20 for holding a supply media, and a sheet output tray 22 for receiving media sheets that have been printed.

Imaging apparatus 10 that is capable of generating a printed output. Examples of machines that may be represented by imaging apparatus 10 include a printer, a copying machine, and a multifunction machine that may include standalone copying and facsimile capabilities, in addition to optionally serving as a printer when attached to a host computer.

Controller 12 of imaging apparatus 10 includes a processor unit and associated memory, and may be formed as an Application Specific Integrated Circuit (ASIC). Controller 12 communicates with user interface 14 via a communications link 24. Controller 12 communicates with print engine 16 via a communications link 26. Controller 12 communicates with sheet feed system 18 via a communications link 28. Each of communications links 24, 26 and 28 may be established, for example, by using one of a standard electrical cabling or bus structure, or by a wireless connection.

User interface 14 may include buttons for receiving user input, such as for example, power on, or print media tray selection. User interface 14 may also include a display screen for displaying information relating to imaging apparatus 10, such as for example, print job status information.

Print engine 16 may be electrophotographic print engine of a type well known in the art, and may include, for example, a laser light source module, a light scanning device, a photoconductive substrate, a developer unit and a fuser unit. The photoconductive substrate may be, for example, a rotating photoconductive drum of a type well known in the electrophotographic imaging arts, and may be formed as a part of an imaging cartridge that includes a supply of toner.

Sheet feed system 18 includes a drive unit 30 communicatively coupled to controller 12 by communications link 28. Drive unit 30 includes one or more motors, such as a DC motor or a stepper motor. Sheet feed system 18 includes, for example, a sheet picker 32, transport roller pairs 34-1, 34-2, 34-3 and 34-4, an input roller pair 36 and a main frame 38. Each pair of rollers 34-1, 34-2, 34-3, 34-4, and 36 may include a driven roller, and a backup roller. The driven rollers of sheet picker 32, transport roller pairs 34-1, 34-2, 34-3 and 34-4, an input roller pair 36 are drivably coupled to one or more drive mechanisms 40, represented by dashed lines. Drive mechanisms 40 may be, for example, a gear arrangement and/or a belt-pulley arrangement, as is known in the art.

During operation, at the directive of controller 12, drive unit 30 and drive mechanisms 40 are actuated such that a media sheet is picked by sheet picker 32 from sheet supply tray 20, and transported by transport roller pairs 34-1, 34-2, 34-3 and 34-4 along a media feed path 42 in media feed direction 44 toward input roller pair 36. Sheet feed system 18 may be configured as a center-fed system, meaning that a media sheet is centered on media feed path 42, regardless of the width of the media sheet. Near the location of input roller pair 36, the media sheet is deskewed in accordance with the present invention, prior to being received by print engine 16.

Figure 2:
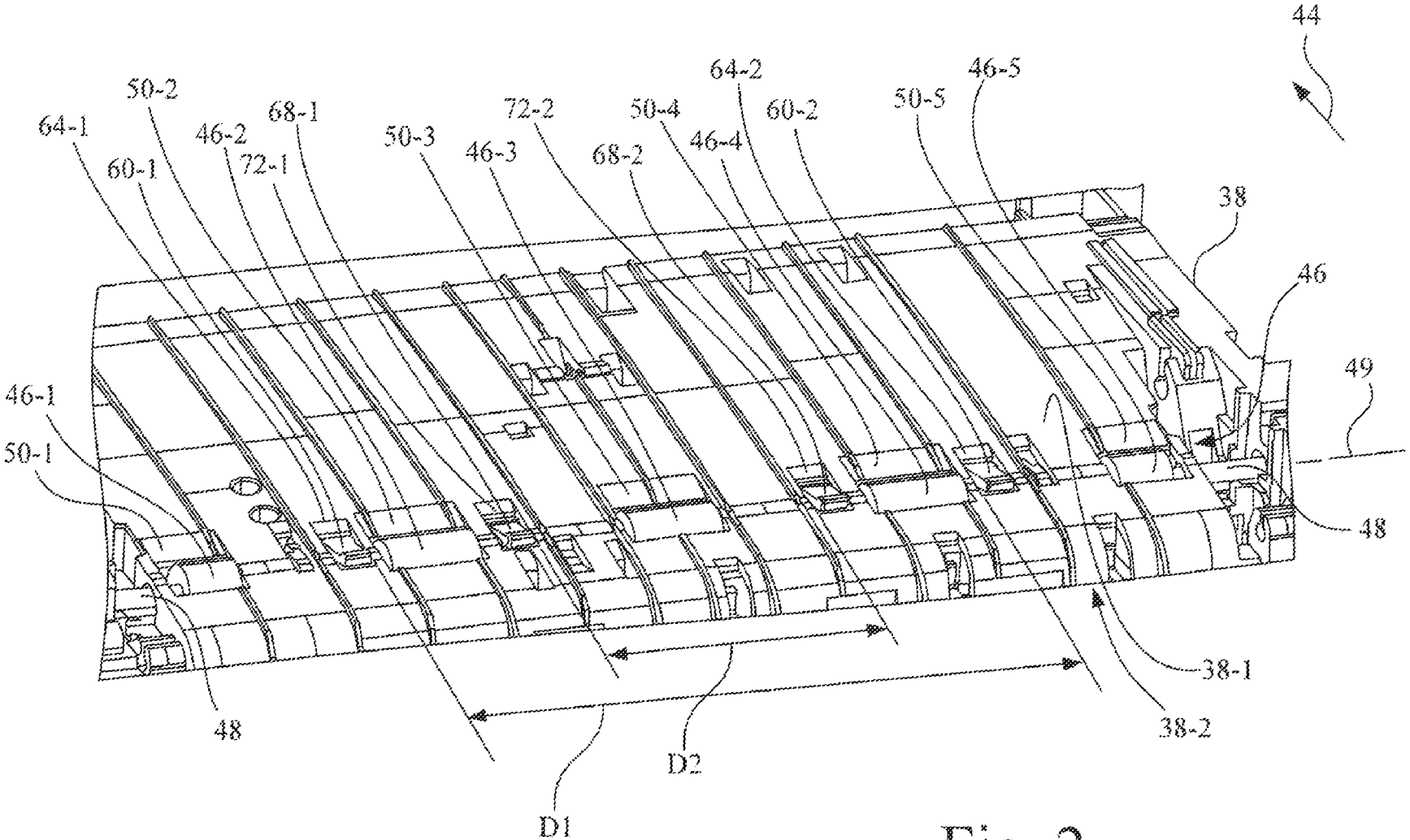
FIG. 2 is a top perspective view of a portion of a main frame having coupled thereto a split alignment gate of the imaging system of FIG. 1.

Referring also to FIG. 2, there is shown a top perspective view of main frame 38. Main frame 38 includes a sheet supporting surface (upper side) 38-1 and an under side 38-2. Input roller pair 36 includes a driven input roller 46 having segmented rollers 46-1, 46-2, 46-3, 46-4 and 46-5 spaced apart and fixedly mounted to a shaft 48. Shaft 48 is rotatably mounted to underside 38-2 of main frame 38, and defines a rotational axis 49. Main frame 38 includes a plurality of openings 50-1, 50-2, 50-3, 50-4 and 50-5 configured for receiving and exposing a portion of segmented rollers 46-1, 46-2, 46-3, 46-4 and 46-5 above the plane of sheet supporting surface 38-1 of main frame 38.

Figure 3:
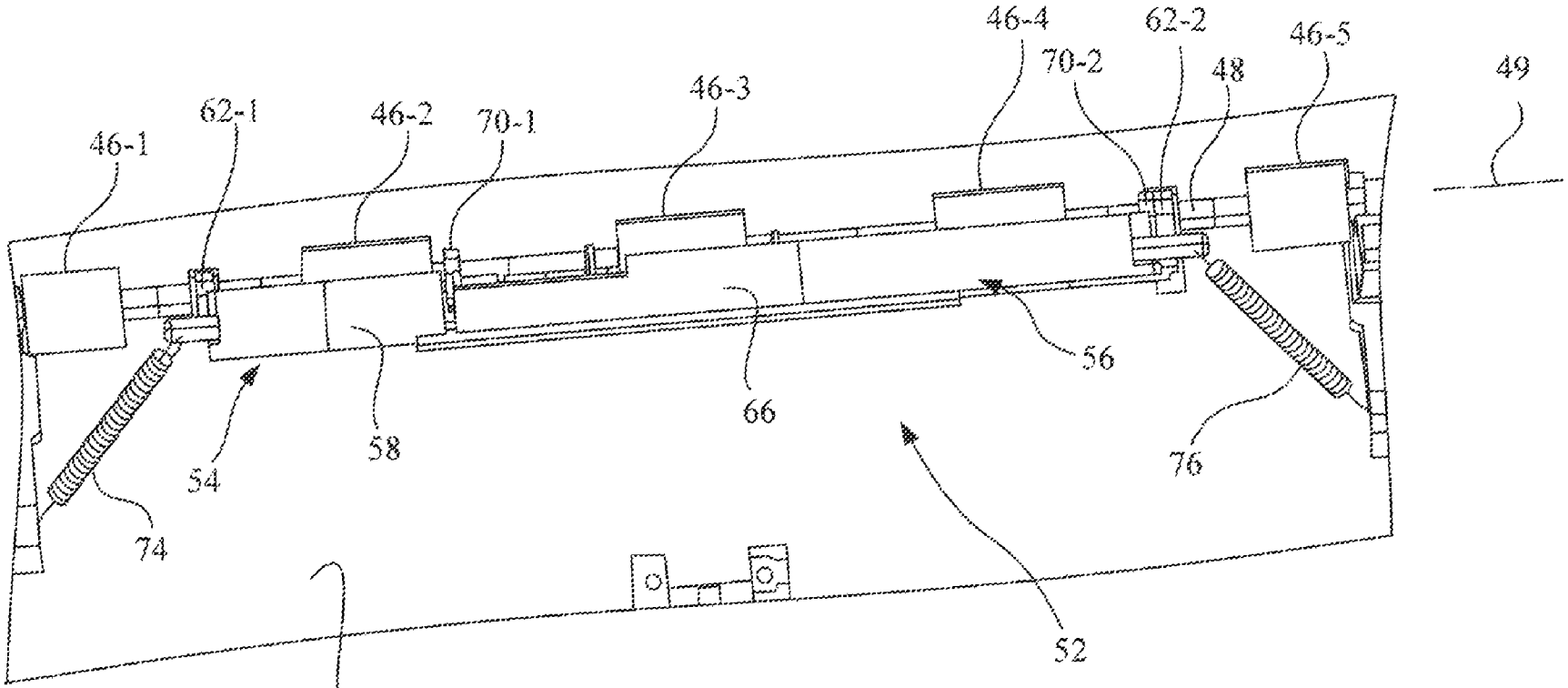
FIG. 3 is a bottom view of the main frame and split alignment gate of FIG. 2.
Figure 4:
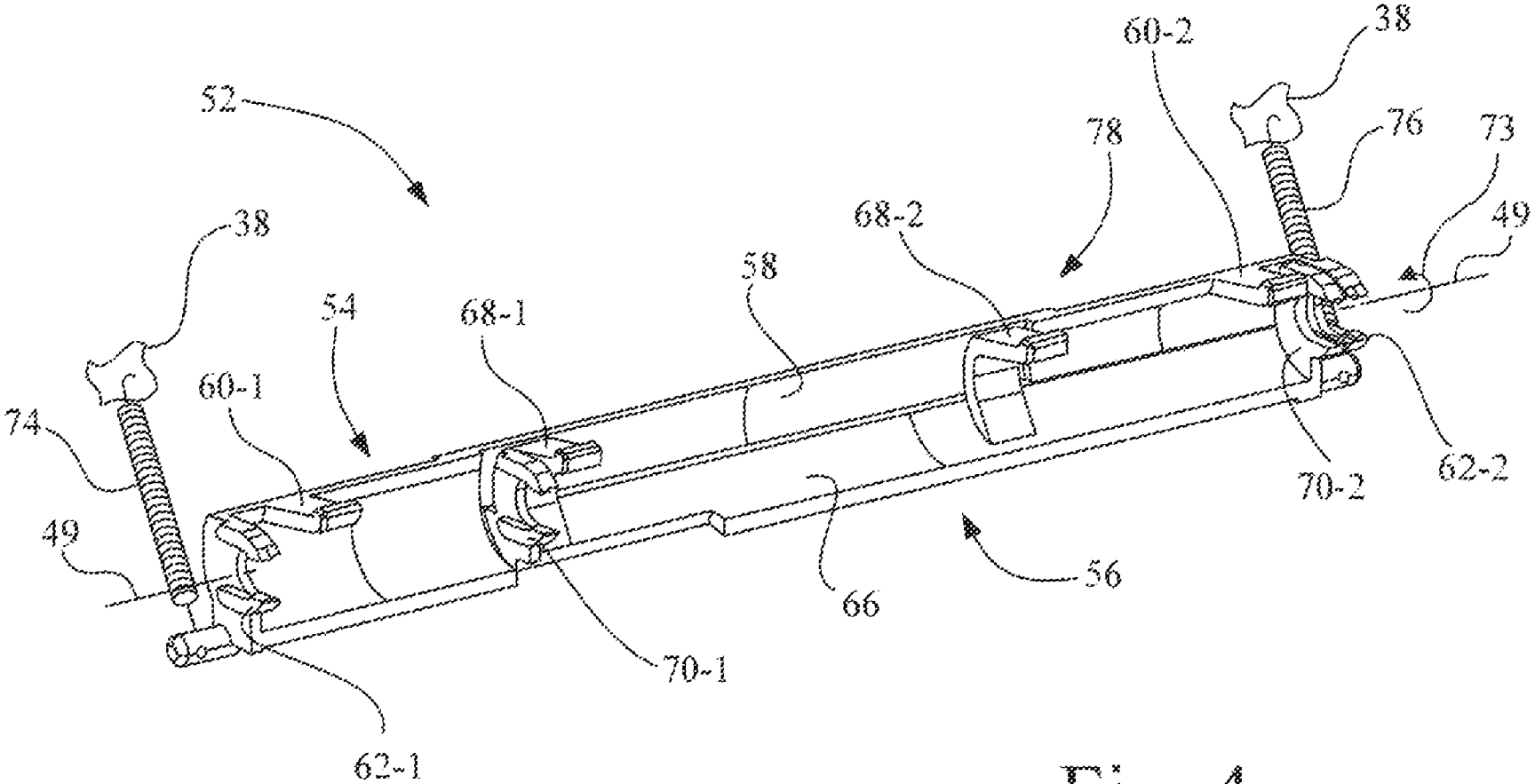
FIG. 4 is a perspective view of the split alignment gate, with the main frame of FIG. 2 broken away to expose the split alignment gate, and with an input roller removed.
Figure 5:
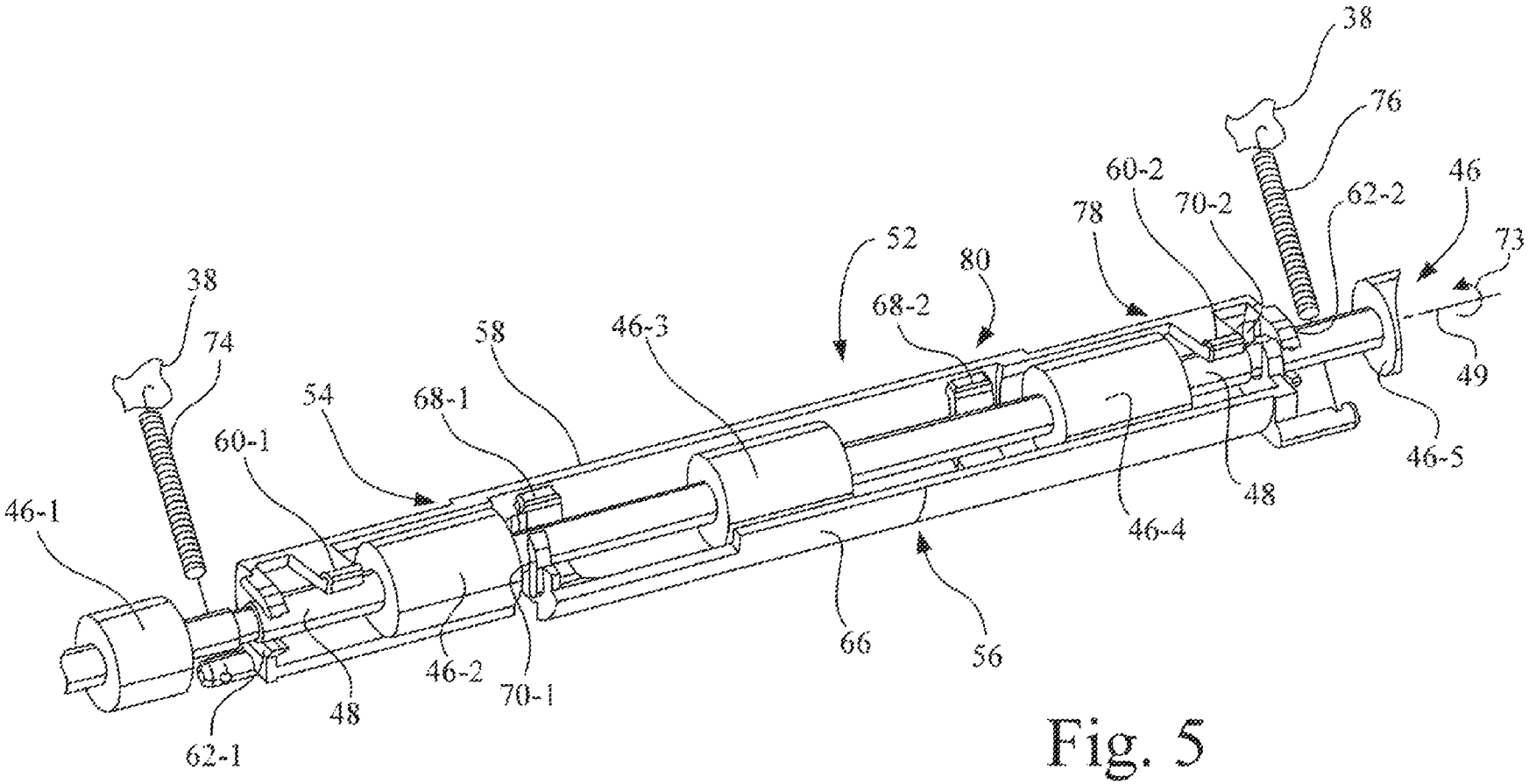
FIG. 5 is another perspective view of the split alignment gate with the main frame broken away, and showing the split alignment gate mounted to the shaft of the input roller.

Referring also to FIGS. 3-5, there is shown a split alignment gate 52 provided for deskewing sheet media. Split alignment gate 52 includes a first gate member 54 and a second gate member 56.

As shown in FIGS. 2, 4 and 5, first gate member 54 includes a body 58 having a pair of gating projections 60-1, 60-2. Gating projection 60-1 is spaced apart from gating projection 60-2 by a distance D1. A pair of C-clip attachment features 62-1, 62-2 is formed at opposing ends of body 58 to facilitate attachment of first gate member 54 to shaft 48 of driven input roller 46, while permitting rotation of shaft 48 independent of split alignment gate 52. Main frame 38 includes a plurality of openings 64-1, 64-2 for respectively receiving and exposing a portion of gating projections 60-1, 60-2 above the plane of sheet supporting surface 38-1 of main frame 38.

Second gate member 56 includes a body 66 having a pair of gating projections 68-1, 68-2. If desired, more gating projections may be added to body 66 to increase and spread out the area of contact with a media sheet. Gating projection 68-1 is spaced from gating projection 68-2 by a distance D2. Gating projections 68-1 and 68-2 of second gate member 56 are positioned between gating projection 60-1 and gating projection 60-1 of first gate member 54. A pair of C-clip attachment features 70-1, 70-2 is formed at opposing ends of body 66 to facilitate attachment of second gate member 56 to shaft 48 of driven input roller 46, while permitting rotation of shaft 48 independent of split alignment gate 52. Main frame 38 includes a plurality of openings 72-1, 72-2 for respectively receiving and exposing a portion of gating projections 68-1, 68-2 above the plane of sheet supporting surface 38-1 of main frame 38.

Referring to FIGS. 3-5, split alignment gate 52 is configured in a shutter-like arrangement, with second gate member 56 configured to pivot about rotational axis 49 independently from first gate member 54. As can be best seen in FIG. 4, when body 58 of first gate member 54 is rotated in rotational direction 73, body 58 will engage and carry body 66 of second gate member 56. However, body 66 of second gate member 56 may be rotated in rotational direction 73 independent of movement of body 58 of first gate member 54, and thus body 58 of first gate member 54 would remain stationary. In other words, in this arrangement, second gate member 56 may pivot while first gate member 54 remains stationary, but not vice-versa.

Figure 6:
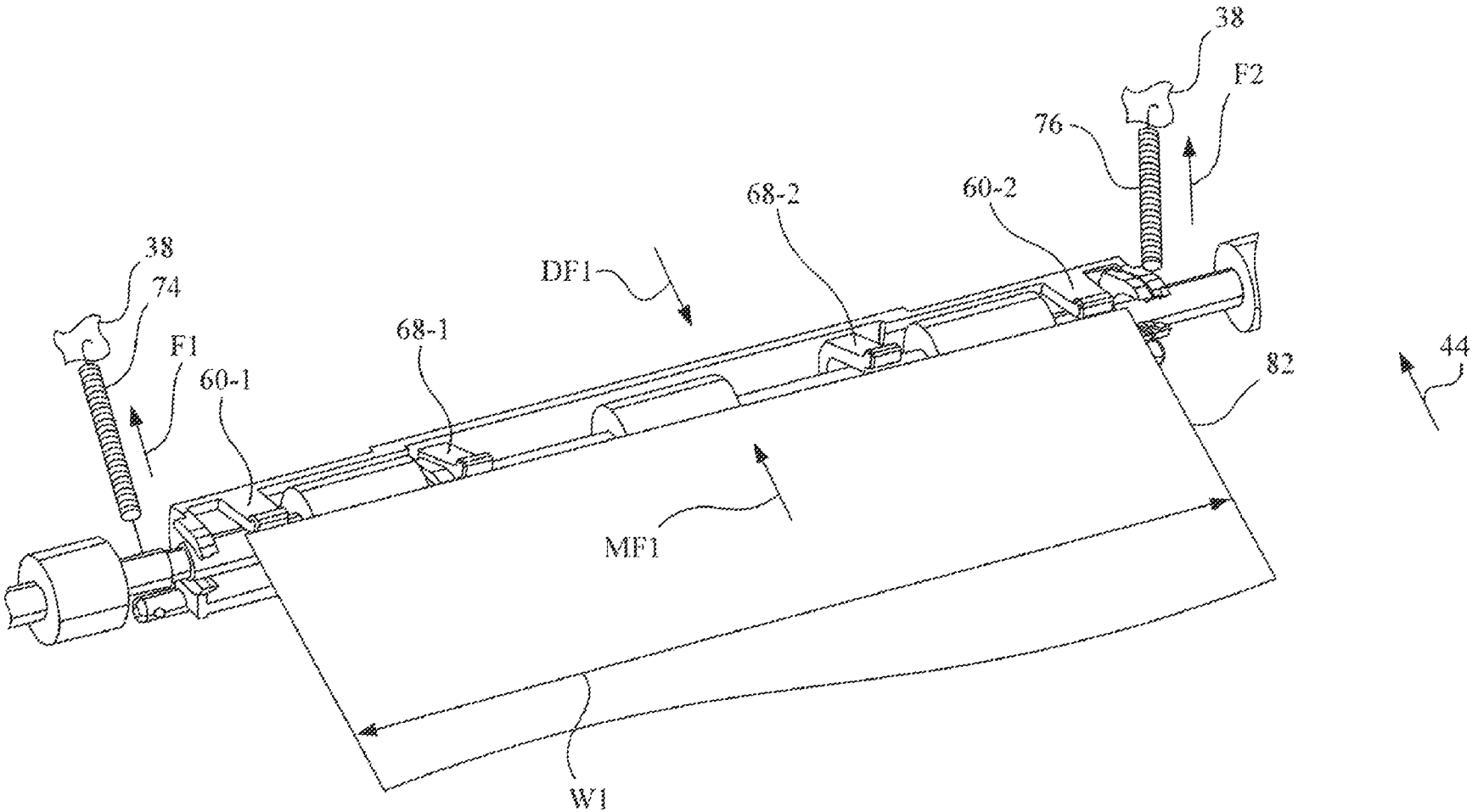
FIG. 6 is another perspective view of the split alignment gate with the main frame broken away, and showing the engagement of the split alignment gate by a wide media.

A first biasing spring 74 is coupled between first gate member 54 and main frame 38 to exert a biasing force F1 as illustrated in FIG. 6. A second biasing spring 76 is coupled between second gate member 56 and main frame 38 to exert a biasing force F2. In view of the shutter-like arrangement of split alignment gate 52, first gate member 54 and second gate member 56 are configured such that first gate member 54 is biased to a gating position 78 (i.e., a raised position; see FIG. 4) by both of first biasing spring 74 and second biasing spring 76. However, second gate member 56 is biased to gating position 78 by only second biasing spring 76.

In FIG. 4, first gate member 54 and corresponding gating projections 60-1, 60-2 are shown in gating position 78, and second gate member 56 and corresponding gating projections 68-1, 68-2 are shown in gating position 78, as would be the case prior to deflection by any media sheet. In FIG. 5, first gate member 54 and corresponding gating projections 60-1, 60-2 are shown in gating position 78, whereas second gate member 56 and corresponding gating projections 68-1, 68-2 are shown in a deflected position (lowered position) 80, as would be the case where a narrow media sheet has engaged gating projections 68-1, 68-2 and deflected second gate member 56 while passing between gating projections 60-1, 60-2 and in turn not deflecting first gate member 54.

Referring to FIGS. 2, 6, 7A and 7B, the spacing distance D1 between gating projection 60-1 and gating projection 60-2 is selected to be less than a width W1 of a wider media sheet 82, and greater than a width W2 of a relatively narrower media sheet 84. Width W1 is greater than width W2. The spacing between gating projection 68-1 and gating projection 68-2 is selected to be less than the width W2 of the narrower media sheet 84. Media sheet 82 may be, for example on of A4 media and letter size media. Media sheet 84 may be, for example, one of A5 media and A6 media. Typically, a narrower media sheet will be less stiff that a wider media sheet, and thus more difficult to deskew without incurring a jam in media feed path 42 at the location of the deskewing operation.

FIG. 6 demonstrates a scenario wherein media sheet 82, having a width W1 in the direction transverse to media feed direction 44 that is greater than distance D1 (see FIG. 2), will engage gating projections 60-1 and 60-2, and must overcome the sum of the forces (F1+F2) exerted by the combination of springs 74, 76 in order to deflect split alignment gate 52 due to the shutter-like arrangement of split alignment gate 52 described above. When media sheet 82 is transported by sheet feed system 18 to engage split alignment gate 52, split alignment gate 52 resists forward conveyance of media sheet 82 in media feed direction 44 (to deskew media sheet 82) until a media engagement force MF1 exerted by media sheet 82 overcomes a deskewing force DF1 exerted by the combination of first biasing spring 74 and second biasing spring 76, at which time each of the gating projections 60-1, 60-2, 68-1, and 68-2 is deflected from gating position 78 to deflected position 80 below media feed path 42 to allow media sheet 82 to pass.

Figure 7A:
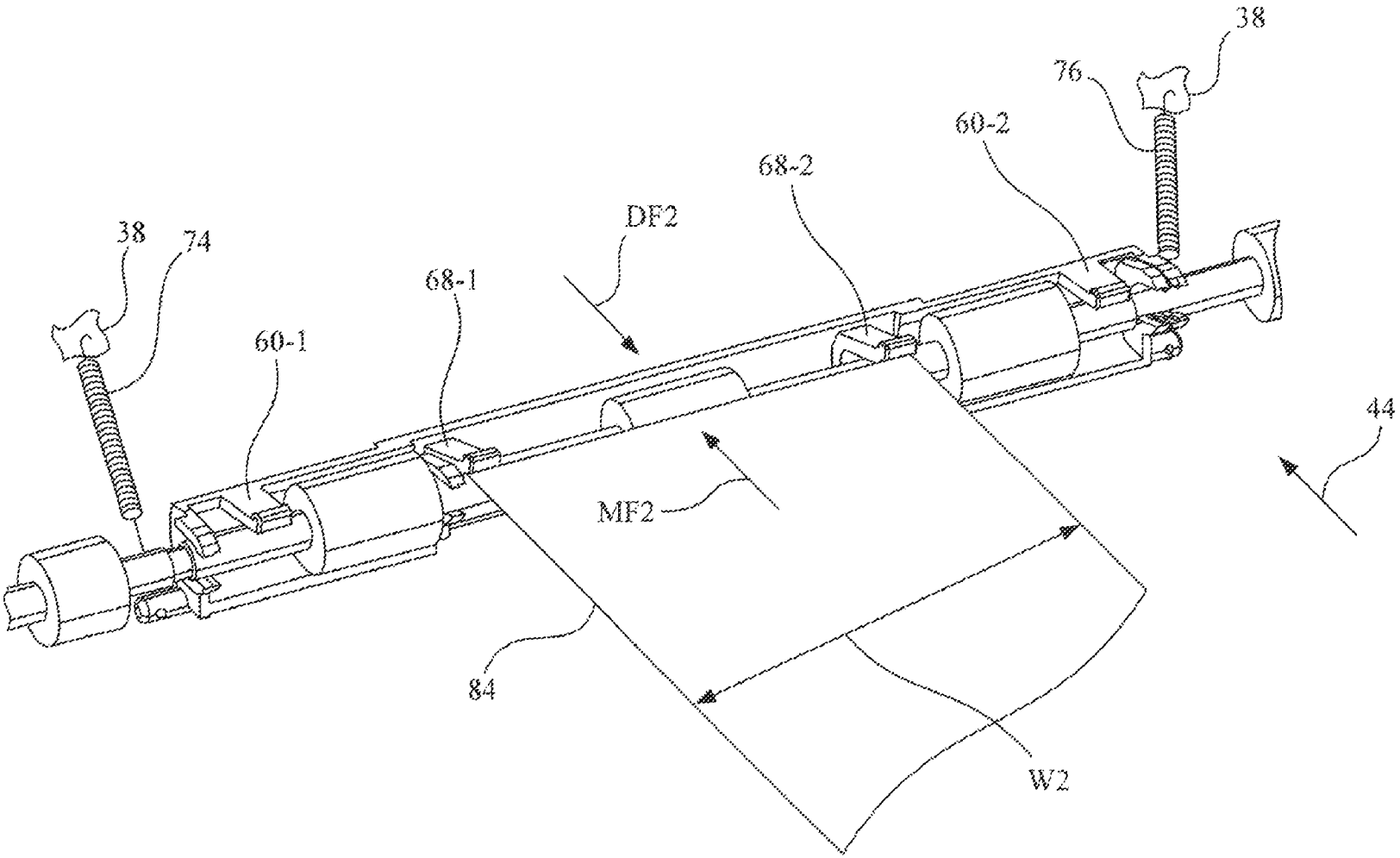
FIG. 7A is another perspective view of the split alignment gate with the main frame broken away, and showing the engagement of the split alignment gate by a narrow media.
Figure 7B:
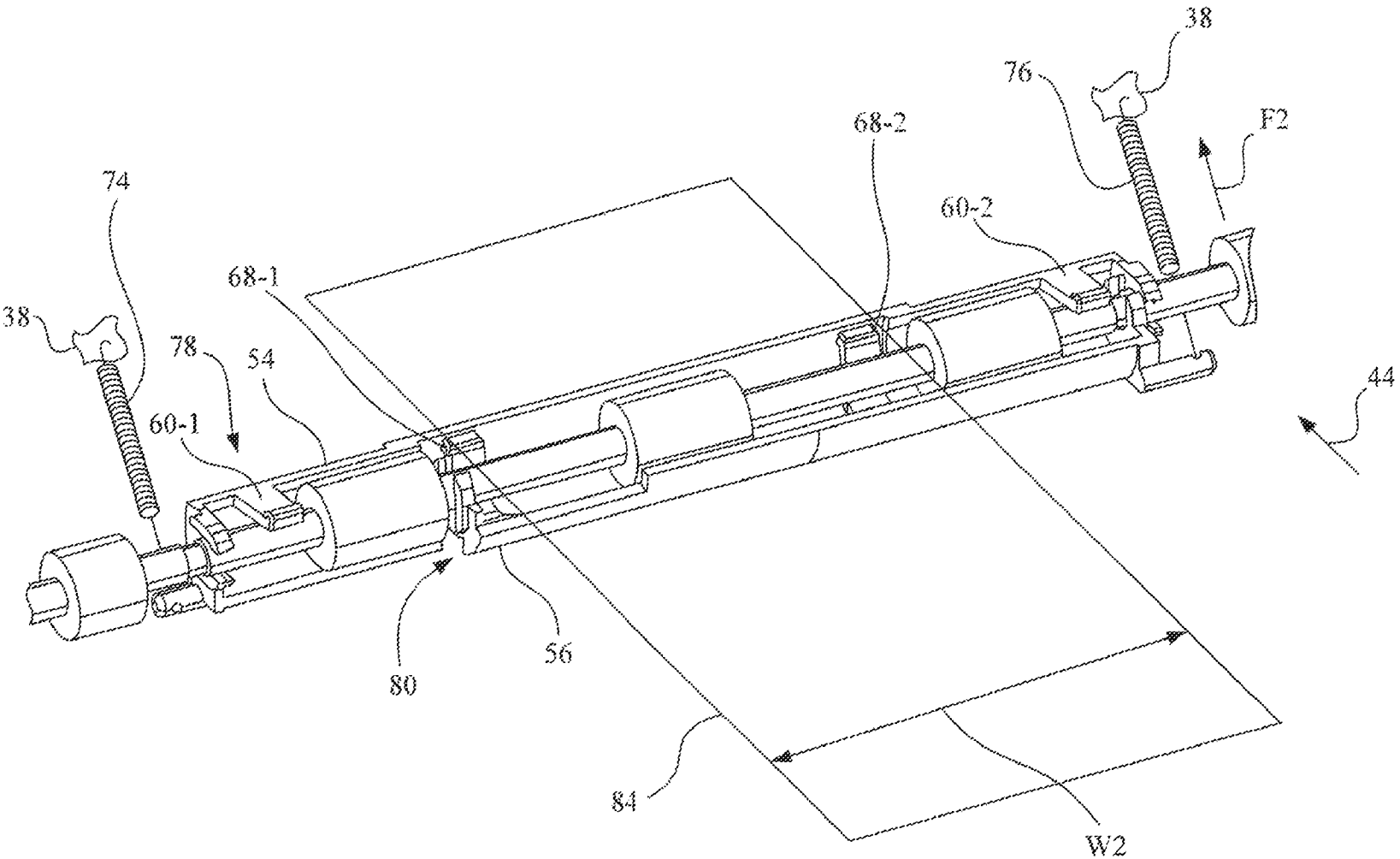
FIG. 7B is another perspective view of the split alignment gate with the main frame broken away, and showing the narrow media of FIG. 7A having passed over the split alignment gate.

FIG. 7A demonstrates a scenario wherein media sheet 84, having a width W2 in the direction transverse to media feed direction 44 that is less than distance D1 but greater than distance D2 (see FIG. 2), will not engage gating projections 60-1 and 60-2, and must only overcome the force F2 exerted by the second spring 76 in order to deflect second gate member 56 of split alignment gate 52, as illustrated in FIG. 7B. When media sheet 84 is transported by sheet feed system 18 to engage split alignment gate 52, split alignment gate 52 resists forward conveyance of media sheet 84 in media feed direction 44 until a media engagement force MF2 exerted by media sheet 84 overcomes a deskewing force DF2 exerted by only second biasing spring 76, at which time gating projection 68-1 and gating projection 68-2 are deflected from gating position 78 to deflected position 80 below media feed path 42 to allow media sheet 84 to pass, while gating projection 60-1 and gating projection 60-2 remain at gating position 78 and are not engaged by media sheet 84.

In FIG. 7B, media sheet 84 is shown as transparent to show the position of second gate member 56 when deflected to the deflected position 80. As shown in FIG. 7B, first gate member 54 having gating projections 60-1 and 60-2 remains stationary in the gating position 78, whereas when force F2 exerted by second biasing spring 76 is overcome, second gate member 56 deflects to the deflected position 80, and media sheet 84 passes over split alignment gate 52 between gating projections 60-1 and 60-2 of first gate member 54.

Thus, in accordance with the above, a media sheet that engages split alignment gate 52 is subjected to a deskewing force, one of DF1 (contributed to be the sum of forces F1+F2) or DF2 (not contributed to by force F1), that is applied by split alignment gate 52, wherein the amount of the deskewing force is determined based on a width of the media sheet in a direction transverse to the media feed direction. The media sheet being transported exerts a media engagement force against the split alignment gate 52, with the media sheet deflecting split alignment gate 52 and passing over split alignment gate 52 when the media engagement force exceeds the deskewing force exerted by split alignment gate 52.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for deskewing a media sheet having a sheet length, with and thickness, comprising:

a sheet feed system for transporting said media sheet along a media feed path in a media feed direction; and a split alignment gate positioned to intersect said media feed path, said split alignment gate subjecting said media sheet to a deskewing force, wherein an amount of said deskewing force is automatically determined based on a width of said media sheet in a direction transverse to said media direction;

wherein said media sheet being transported exerts a media engagement force against said split alignment gate, said media sheet deflecting and passing over said split alignment gate when said media engagement force said deskewing force;

wherein said split alignment gate is coupled to a frame, said split alignment gate includes a first gate member and a second gate member;

a first biasing spring coupled between said first gate member and said frame;

a second biasing spring coupled between said second gate member and said frame;

said first gate member and a second gate member being configured such that said first gate member is biased to a gating position by both said first biasing spring and said second biasing spring, and said second gate member is biased to said gating position by only said second biasing spring.

2. The apparatus of claim 1, said first gate member having a first gating projection spaced apart from a second gating projection, said second gate member having a third gating projection spaced apart from a fourth gating projection, said third gating projection and said fourth gating projection of said second gate member being positioned between said first gating projection and said second gating projection of said first gate member.

3. The apparatus of claim 2, wherein said sheet feed system is configured to transport either of a first media sheet having a first width and a second media sheet having a second width less than said first width, wherein a spacing between said first gating projection and said second gating projection is selected to be less than said first width of said first media sheet and greater than said second width of said second media sheet, and wherein a spacing between said third gating projection and said fourth gating projection is selected to be less than said second width of said second media sheet.

4. An imaging apparatus, comprising:

a print engine;

a sheet feed system configured to transport sheet media in a media feed direction along a media feed path to said print engine, said sheet feed system including a main frame and a plurality of rollers; said plurality of rollers includes at least one roller having a shaft oriented transverse to said media feed direction that is rotatably mounted to said main frame;

a split alignment gate coupled to said main frame, said split alignment gate having a first gate member and a second gate member; said split alignment gate is attached to and rotatable about said shaft of said at least one roller;

a first biasing spring coupled between said first gate member and main frame; and a second biasing spring coupled between said second gate member and said main frame, said first gate member and said second gate member being configured such that said first gate member is biased to a gating position by both said first biasing spring and said second biasing spring, and said second gate member is biased to said gating position by only said second biasing spring.

5. The imaging apparatus of claim 4, wherein said at least one roller comprises a driven input roller, said driven input roller having a shaft oriented transverse to said media feed direction that is rotatably mounted to said main frame.

6. The imaging apparatus of claim 4, wherein said first gate member having a first gating projection spaced apart from a second gating projection, said second gate member having a third gating projection spaced apart from a fourth gating projection, said third gating projection and said fourth gating projection of said second gate member being positioned between said first gating projection and said second gating projection of said first gate member.

7. The imaging apparatus of claim 6, wherein said sheet feed system is configured to transport either of a first media sheet having a first width and a second media sheet having a second width less than said first width, wherein a spacing between said first gating projection and said second gating projection is selected to be less than said first width of said first media sheet and greater than said second width of said second media sheet.

8. The imaging apparatus of claim 7, wherein a spacing between said third gating projection and said fourth gating projection is selected to be less than said second width of said second media sheet.

9. The imaging apparatus of claim 8, wherein:

when said first media sheet is transported by said sheet feed system to engage said split alignment gate, said split alignment gate resists forward conveyance of said first media sheet in said media feed direction until a media engagement force exerted by said first media sheet overcomes a biasing force exerted by the combination of said first biasing spring and said second biasing spring, at which time each of said first gating projection, said second gating projection, said third gating projection and said fourth gating projection is deflected from said gating position to a position below said media feed path to allow said first media sheet to pass; and when said second media sheet is transported by said sheet feed system to engage said split alignment gate, said split alignment gate resists forward conveyance of said first media sheet in said media feed direction until a media engagement force exerted by said second media sheet overcomes a biasing force exerted by only said second biasing spring, at which time said third gating projection and said fourth gating projection are deflected from said gating position to a position below said media feed path to allow said second media sheet to pass, while said first gating projection and said second gating projection remain at said gating position and are not engaged by said second media sheet.

10. The imaging apparatus of claim 9, wherein said first media sheet is one of A4 media and letter size media, and said second media sheet is one of A5 media and A6 media.

11. An imaging apparatus, comprising:

a print engine;

a sheet feed system configured to transport sheet media in a media feed direction along a media feed path to said print engine, said sheet feed system including a main frame and an input roller;

a split alignment gate attached to said shaft of said input roller, said split alignment gate having a first gate member and a second gate member, said first gate member having a first gating projection spaced apart from a second gating projection, said second gate member having a third gating projection spaced apart from a fourth gating projection, said third gating projection and said fourth gating projection of said second gate member being positioned between said first gating projection and said second gating projection of said first gate member;

a first biasing spring coupled between said first gate member and main frame; and a second biasing spring coupled between said second gate member and said main frame, said first gate member and said second gate member being configured such that first gate member is biased to a gating position by both said first biasing spring and said second biasing spring, and said second gate member is biased to said gating position by only said second biasing spring.

12. The imaging apparatus of claim 11, wherein said first gating projection and said second gating projection extend though corresponding openings of said plurality of openings in said main frame and are positioned to intersect said media feed path when said first gate member is biased to said gating position, and wherein said third gating projection and said fourth gating projection extend though corresponding openings of said plurality of openings in said main frame and are positioned to intersect said media feed path when said second gate member is biased to said gating position.

13. The imaging apparatus of claim 12, wherein said sheet feed system is configured to transport either of a first media sheet having a first width and a second media sheet having a second width less than said first width, wherein a spacing between said first gating projection and said second gating projection is selected to be less than said first width of said first media sheet and greater than said second width of said second media sheet.

14. The imaging apparatus of claim 13, wherein a spacing between said third gating projection and said fourth gating projection is selected to be less than said second width of said second media sheet.

15. The imaging apparatus of claim 14, wherein:

when said first media sheet is transported by said sheet feed system to engage said split alignment gate, said split alignment gate resists forward conveyance of said first media sheet in said media feed direction until a media engagement force exerted by said first media sheet overcomes a biasing force exerted by the combination of said first biasing spring and said second biasing spring, at which time each of said first gating projection, said second gating projection, said third gating projection and said fourth gating projection is deflected from said gating position to a position below said media feed path to allow said first media sheet to pass; and when said second media sheet is transported by said sheet feed system to engage said split alignment gate, said split alignment gate resists forward conveyance of said first media sheet in said media feed direction until a media engagement force exerted by said second media sheet overcomes a biasing force exerted by only said second biasing spring, at which time said third gating projection and said fourth gating projection are deflected from said gating position to a position below said media feed path to allow said second media sheet to pass, while said first gating projection and said second gating projection remain at said gating position and are not engaged by said second media sheet.

16. The imaging apparatus of claim 15, wherein said first media sheet is one of A4 media and letter size media, and said second media sheet is one of A5 media and A6 media.

17. The apparatus of claim 1, wherein a first end portion of said first biasing spring is directly coupled to a said first gate member and a second end portion of said first biasing spring is directly coupled to said frame, and a first end portion of said second biasing spring is directly coupled to said second gate member and a second end portion of said second biasing spring is directly coupled to said frame.

18. The imaging apparatus of claim 11, wherein said input roller is a driven roller, and said main frame has a plurality of openings, said driven input roller having a shaft oriented transverse to said media feed direction that is rotatably mounted to said main frame.

19. An imaging apparatus, comprising:

a print engine;

a sheet feed system configured to transport sheet media feed direction along a media feed path to said print engine, said sheet feed system including a main frame and at least one roller;

a split alignment gate coupled to said main frame, said split alignment gate having a first gate member and a second gate member;

a first biasing spring coupled between said first gate member and said main frame such that an end portion of said first biasing spring is directly coupled to said main frame; and a second biasing spring coupled between said second gate member and said main frame such that an end portion of said second biasing spring is directly coupled to said main frame, said first gate member and said second gate member being configured such that said first gate member is biased to a gating position by both said first biasing spring and said second biasing spring, and said second gate member is biased to said gating position by only said second biasing spring.

* * * * *